US011324324B2

(12) United States Patent
Bucholz et al.

(10) Patent No.: US 11,324,324 B2
(45) **Date of Patent: *May 10, 2022**

(54) FURNITURE MEMBER HAVING LUMBAR ADJUSTMENT MECHANISM

(71) Applicant: La-Z-Boy Incorporated, Monroe, MI (US)

(72) Inventors: Brandon Bucholz, Chattanooga, TN (US); Alexander M. Hegedus, Chattanooga, TN (US); Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/313,272

(22) Filed: May 6, 2021

(65) Prior Publication Data

US 2021/0251388 A1 Aug. 19, 2021

Related U.S. Application Data

(63) Continuation-in-part of application No. 17/208,197, filed on Mar. 22, 2021, which is a continuation of (Continued)

(51) Int. Cl.
*A47C 7/48* (2006.01)
*A47C 7/46* (2006.01)

(52) U.S. Cl.
CPC ..... *A47C 7/462* (2013.01)

(58) Field of Classification Search
CPC ..... B60N 2/6671; B60N 2/6673; B60N 2/66; B60N 2/666; A47C 7/46; A47C 1/03255; (Continued)

(56) References Cited

U.S. PATENT DOCUMENTS 3,588,170 A 6/1971 Knabusch et al.
3,890,000 A 6/1975 Easley
(Continued)

FOREIGN PATENT DOCUMENTS

CN 201438906 U 4/2010
DE 3600790 A1 7/1987
(Continued)

OTHER PUBLICATIONS

International Search Report for Application No. PCT/US2011/047371, dated Apr. 9, 2012.
(Continued)

*Primary Examiner* — Shin H Kim
(74) *Attorney, Agent, or Firm* — Harness, Dickey & Pierce, P.L.C.

(57) ABSTRACT

A seating or furniture assembly may include a seat bottom, a seatback, and a lumbar adjustment assembly. The seatback is disposed adjacent the seat bottom and includes a seatback frame. The lumbar adjustment assembly may be mounted to the seatback frame and may include a rail, a threaded rod disposed within the rail, a first slider block slidably engaging the rail, a second slider block slidably engaging the rail, a third slider block engaging the rail, a lumbar pad, and a plurality of links connecting the lumbar pad to the first, second, and third slider blocks. The threaded rod includes a first threaded section having threads with a first handedness and a second threaded section having threads with a second handedness that is opposite the first handedness. The first and second slider blocks threadably engage the first threaded section. The third slider block threadably engage the second threaded section.

20 Claims, 10 Drawing Sheets

Related U.S. Application Data application No. 16/672,878, filed on Nov. 4, 2019, now Pat. No. 10,952,535.

(60) Provisional application No. 62/755,849, filed on Nov. 5, 2018.

(58) Field of Classification Search
CPC ..... A47C 7/462; A47C 1/023; A47C 1/03238; A47C 1/03274
See application file for complete search history.

(56) References Cited

U.S. PATENT DOCUMENTS

| | | | |
|---|---|---|---|
| 4,072,287 | A | 2/1978 | Swenson et al. |
| 4,148,522 | A | 4/1979 | Sakurada et al. |
| 4,182,533 | A | 1/1980 | Arndt et al. |
| 4,295,681 | A | 10/1981 | Gregory |
| 4,296,965 | A | 10/1981 | Sakurada et al. |
| 4,354,709 | A | 10/1982 | Schuster |
| 4,469,374 | A | 9/1984 | Kashihara et al. |
| 4,678,230 | A | 7/1987 | Winkle |
| 4,725,095 | A | 2/1988 | Benson et al. |
| 4,968,093 | A | 11/1990 | Dal Monte |
| 4,981,325 | A | 1/1991 | Zacharkow |
| 5,007,677 | A | 4/1991 | Ozawa et al. |
| 5,087,098 | A | 2/1992 | Ishizuka |
| 5,088,790 | A | 2/1992 | Wainwright et al. |
| 5,217,278 | A | 6/1993 | Harrison et al. |
| 5,240,308 | A | 8/1993 | Goldstein et al. |
| 5,299,851 | A | 4/1994 | Lin |
| 5,462,335 | A | 10/1995 | Seyler |
| 5,474,358 | A | 12/1995 | Maeyaert |
| 5,482,350 | A | 1/1996 | Komorowski et al. |
| 5,507,559 | A | 4/1996 | Lance |
| 5,553,919 | A | 9/1996 | Dennis |
| 5,651,580 | A | 7/1997 | LaPointe et al. |
| 5,730,494 | A | 3/1998 | LaPointe et al. |
| 5,871,258 | A | 2/1999 | Battey et al. |
| 5,927,144 | A | 7/1999 | Koch |
| 5,979,984 | A | 11/1999 | DeKraker et al. |
| 5,984,407 | A | 11/1999 | Ligon, Sr. et al. |
| 6,086,153 | A | 7/2000 | Heidmann et al. |
| 6,116,695 | A | 9/2000 | Heidmann et al. |
| 6,179,384 | B1 | 1/2001 | DeKraker et al. |
| 6,254,186 | B1 | 7/2001 | Falzon |
| 6,257,664 | B1 | 7/2001 | Chew et al. |
| 6,357,826 | B1 | 3/2002 | Gabas et al. |
| 6,367,877 | B1 | 4/2002 | Knoblock et al. |
| 6,394,545 | B2 | 5/2002 | Knoblock et al. |
| 6,394,548 | B1 | 5/2002 | Battey et al. |
| 6,394,549 | B1 | 5/2002 | DeKraker et al. |
| 6,402,246 | B1 | 6/2002 | Mundell |
| 6,520,580 | B1 | 2/2003 | Hong |
| 6,572,190 | B2 | 6/2003 | Koepke et al. |
| 6,575,530 | B1 | 6/2003 | Fischer et al. |
| 6,609,755 | B2 | 8/2003 | Koepke et al. |
| 6,616,228 | B2 | 9/2003 | Heidmann |
| 6,631,951 | B2 | 10/2003 | Blendea et al. |
| 6,676,214 | B2 | 1/2004 | McMillen et al. |
| 6,695,402 | B2 | 2/2004 | Sloan, Jr. |
| 6,729,691 | B2 | 5/2004 | Koepke et al. |
| 6,880,886 | B2 | 4/2005 | Bodnar et al. |
| 6,908,153 | B2 | 6/2005 | Blendea |
| 6,932,430 | B2 | 8/2005 | Bedford et al. |
| 6,938,955 | B2 | 9/2005 | VanSickle |
| 7,007,568 | B2 | 3/2006 | MacAulay et al. |
| 7,014,269 | B2 | 3/2006 | Coffield et al. |
| 7,044,551 | B2 | 5/2006 | Fujita et al. |
| 7,066,537 | B2 | 6/2006 | Coffield et al. |
| 7,131,694 | B1 | 11/2006 | Buffa |
| 7,140,681 | B2 | 11/2006 | McMillen |
| 7,165,811 | B2 | 1/2007 | Bodnar et al. |
| 7,204,556 | B2 | 4/2007 | Schwerdtner et al. |
| 7,226,130 | B2 | 6/2007 | Tubergen et al. |
| 7,264,311 | B2 | 9/2007 | Heidmann |
| 7,448,684 | B2 | 11/2008 | Hsiao |
| 7,770,972 | B2 | 8/2010 | Popa |
| 8,091,966 | B2 | 1/2012 | Schweizer et al. |
| 8,091,967 | B2 | 1/2012 | Schweizer et al. |
| 8,474,909 | B2 | 7/2013 | LaPointe et al. |
| 8,506,009 | B2 | 8/2013 | LaPointe et al. |
| 8,807,651 | B2 | 8/2014 | LaPointe et al. |
| 9,604,559 | B2 | 3/2017 | Yoo |
| 9,732,832 | B2 | 8/2017 | Kristen |
| 9,744,891 | B2 | 8/2017 | Cho et al. |
| 10,066,717 | B2 | 9/2018 | Kristen |
| 2002/0113472 | A1 | 8/2002 | Blendea et al. |
| 2002/0195854 | A1 | 12/2002 | Hong |
| 2003/0006636 | A1 | 1/2003 | Ligon et al. |
| 2004/0104609 | A1 | 6/2004 | Blendea |
| 2004/0108760 | A1 | 6/2004 | McMillen |
| 2004/0160099 | A1 | 8/2004 | Hong |
| 2005/0046251 | A1 | 3/2005 | Foelster et al. |
| 2006/0244293 | A1 | 11/2006 | Buffa |
| 2007/0108816 | A1 | 5/2007 | McQueen et al. |
| 2008/0164738 | A1 | 7/2008 | Colja et al. |
| 2008/0217978 | A1 | 9/2008 | Stossel et al. |
| 2009/0079245 | A1 | 3/2009 | Marcantoni |
| 2010/0033002 | A1 | 2/2010 | Di Giusto et al. |
| 2011/0115268 | A1 | 5/2011 | Maierhofer et al. |
| 2011/0127817 | A1 | 6/2011 | Yu et al. |
| 2012/0068508 | A1 | 3/2012 | LaPointe et al. |
| 2013/0341982 | A1 | 12/2013 | Maierhofer et al. |
| 2014/0070583 | A1 | 3/2014 | McMillen et al. |
| 2014/0070584 | A1 | 3/2014 | McMillen et al. |
| 2014/0125101 | A1 | 5/2014 | Hong |
| 2014/0125102 | A1 | 5/2014 | McMillen et al. |
| 2014/0125103 | A1 | 5/2014 | Suzuki |
| 2015/0305506 | A1 | 10/2015 | Suzuki et al. |
| 2016/0250957 | A1 | 9/2016 | Yoo |

FOREIGN PATENT DOCUMENTS

| | | | |
|---|---|---|---|
| EP | 0458440 | A1 | 11/1991 |
| JP | S6137212 | A | 2/1986 |
| JP | S6137213 | A | 2/1986 |
| JP | H01143958 | U | 10/1989 |
| JP | H05207920 | A | 8/1993 |
| JP | H0819452 | A | 1/1996 |
| JP | 2003159149 | A | 6/2003 |
| JP | 2014094598 | A | 5/2014 |
| KR | 20030075271 | A | 9/2003 |
| KR | 101149075 | B1 | 5/2012 |
| KR | 101388983 | B1 | 4/2014 |
| KR | 20140048743 | A | 4/2014 |
| KR | 101491313 | B1 | 2/2015 |
| WO | WO-2008006200 | A1 | 1/2008 |

OTHER PUBLICATIONS

Written Opinion of the International Searching Authority for Application No. PCT/US2011/047371, dated Apr. 9, 2012.

Supplementary European Search Report for Application No. 11827153.5, dated Jan. 21, 2014.

International Search Report for Application No. PCT/US2019/059803, dated Apr. 7, 2020.

Written Opinion of the International Searching Authority for Application No. PCT/US2019/059803, dated Apr. 7, 2020.

FURNITURE MEMBER HAVING LUMBAR ADJUSTMENT MECHANISM

CROSS-REFERENCE TO RELATED APPLICATIONS

This application is a continuation-in-part of U.S. patent application Ser. No. 17/208,197 filed on Mar. 22, 2021, which is a continuation of U.S. patent application Ser. No. 16/672,878 filed on Nov. 4, 2019, which claims the benefit of U.S. Provisional Application No. 62/755,849 filed on Nov. 5, 2018. The entire disclosures of each of the above applications are incorporated herein by reference.

FIELD

The present disclosure relates to an adjustment mechanism, such as a lumbar adjustment mechanism for a seating or furniture assembly.

BACKGROUND

This section provides background information related to the present disclosure and is not necessarily prior art.

A furniture member (e.g., a chair, sofa, loveseat, etc.) may include an adjustable lumbar support that allows a user to adjust the amount of support that a seatback of the furniture member provides at a lumbar portion of the user's back. The present disclosure provides a lumbar adjustment assembly that is compact in size while still providing a sufficiently large range of motion. The lumbar adjustment assembly of the present disclosure fits within a slimmer space within a seatback frame, which allows for a larger variety of aesthetic designs of the seatback without sacrificing functionality. Furthermore, the lumbar adjustment assembly of the present disclosure provides appropriate support in a wider width seat, such as in an oversized armchair (or "chair and a half"), for example.

SUMMARY

This section provides a general summary of the disclosure, and is not a comprehensive disclosure of its full scope or all of its features.

The present disclosure provides an assembly (e.g., a seating or furniture assembly) that may include a seat bottom, a seatback, and an adjustment assembly. The seatback is disposed adjacent the seat bottom and includes a seatback frame. The lumbar adjustment assembly may be mounted to the seatback frame and may include a rail, a threaded rod disposed within the rail, first slider block slidably engaging the rail, a second slider block slidably engaging the rail, a third slider block slidably engaging the rail, one or more lumbar pads, and a plurality of links connecting the lumbar pad to the first, second, and third slider blocks. The threaded rod may include a first threaded section having threads with a first handedness and a second threaded section having threads with a second handedness that is opposite the first handedness. The first and second slider blocks may threadably engage the first threaded section. The third slider block may threadably engage the second threaded section.

In some configurations of the assembly of the above paragraph, the assembly includes a motor assembly attached to the rail and rotatably driving the threaded rod relative to the rail.

In some configurations of the assembly of either of the above paragraphs, the links include a pair of first links, a pair of second links, and a pair of third links.

In some configurations of the assembly of any or more of the above paragraphs, a first end of each of the first links is rotatably coupled to the first slider block, a second end of each of the first links is rotatably coupled to the lumbar pad, a first end of each of the second links is rotatably coupled to the second slider block, a second end of each of the second links is rotatably coupled to the lumbar pad, a first end of each of the third links is rotatably coupled to the third slider block, and a second end of each of the third links is rotatably coupled to the lumbar pad.

In some configurations of the assembly of any or more of the above paragraphs, the second ends of the first links, the second ends of the second links, and the second ends of the third links are rotatably coupled to the lumbar pad at first, second, and third rotational axes, respectively. The first, second, and third rotational axes may be spaced apart from each other and parallel to each other.

In some configurations of the assembly of any or more of the above paragraphs, the lumbar pad moves in a direction perpendicular to directions in which the first, second, and third slider blocks move along the rail.

In some configurations of the assembly of any or more of the above paragraphs, the lumbar pad moves away from the rail when the first and second slider blocks move toward the third slider block along the rail, and the lumbar pad moves toward from the rail when the first and second slider blocks move away from the third slider block along the rail.

In some configurations of the assembly of any or more of the above paragraphs, the seatback frame includes a lower cross member, an upper cross member, a first lateral support member, and a second lateral support member. A motor assembly of the adjustment assembly may be attached to the first lateral support member and the rail is attached to the second lateral support member.

In some configurations of the assembly of any or more of the above paragraphs, each of the first, second, and third slider blocks includes a channel that slidably and non-rotatably receives the rail.

In some configurations of the assembly of any or more of the above paragraphs, the threaded rod is a single, unitary body.

The present disclosure also provides an assembly (e.g., a seating or furniture assembly) that may include a frame, a motor assembly, a rail, a threaded rod, a first slider block, a second slider block, a third slider block, and a plurality of links. The motor assembly may include a housing attached to the frame. The rail may include a first end attached to the motor assembly and a second end attached to the frame. The threaded rod may be coupled to the motor assembly and may be disposed within a channel of the rail. The threaded rod may include a first threaded section having threads with a first handedness and a second threaded section having threads with a second handedness that is opposite the first handedness. The first slider block may slidably engage the rail and may threadably engage the first threaded section. The second slider block may slidably engage the rail and may threadably engage the first threaded section. The third slider block may slidably engage the rail and may threadably engage the second threaded section. The plurality of links may be rotatably coupled to the first, second, and third slider blocks.

In some configurations of the assembly of the above paragraph, the assembly includes a support member attached to the plurality of links.

In some configurations of the assembly of either of the above paragraphs, the support member is a lumbar pad, and the frame is a seatback frame.

In some configurations of the assembly of any one or more of the above paragraphs, the seatback frame includes a lower cross member, an upper cross member, a first lateral support member, and a second lateral support member. The housing of the motor assembly may be attached to the first lateral support member and the second end of the rail may be attached to the second lateral support member.

In some configurations of the assembly of any one or more of the above paragraphs, the links include a pair of first links, a pair of second links, and a pair of third links.

In some configurations of the assembly of any one or more of the above paragraphs, a first end of each of the first links is rotatably coupled to the first slider block, a second end of each of the first links is rotatably coupled to the support member, a first end of each of the second links is rotatably coupled to the second slider block, a second end of each of the second links is rotatably coupled to the support member, a first end of each of the third links is rotatably coupled to the third slider block, and a second end of each of the third links is rotatably coupled to the support member.

In some configurations of the assembly of any one or more of the above paragraphs, the second ends of the first, second, and third links are rotatably coupled to the support member at first, second, and third rotational axes, respectively. The first, second, and third rotational axes may be spaced apart from each other and parallel to each other.

In some configurations of the assembly of any one or more of the above paragraphs, the support member moves in a direction perpendicular to directions in which the first, second, and third slider blocks move along the rail.

In some configurations of the assembly of any one or more of the above paragraphs, the support member moves away from the rail when the first and second slider blocks move toward the third slider block along the rail, and the support member moves toward from the rail when the first and second slider blocks move away from the third slider block along the rail.

In some configurations of the assembly of any one or more of the above paragraphs, each of the first, second, and third slider blocks includes a channel that slidably and non-rotatably receives the rail.

In some configurations of the assembly of any one or more of the above paragraphs, the threaded rod is a single, unitary body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
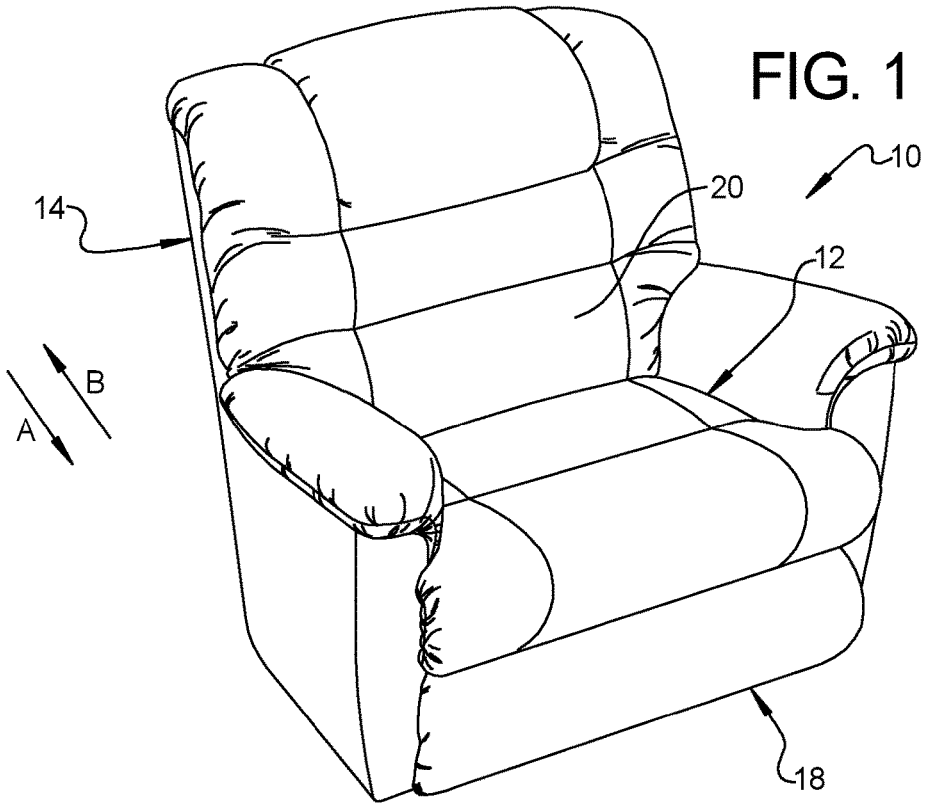
FIG. 1 is a perspective view of a furniture member with a legrest mechanism in a retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
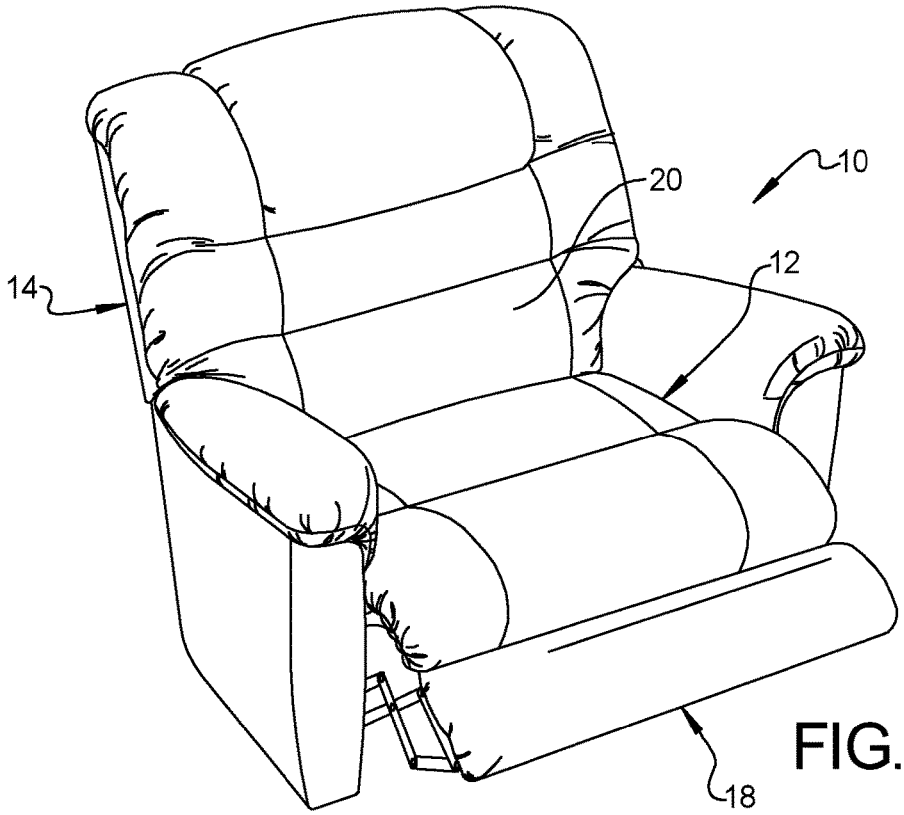
FIG. 2 is a perspective view of the furniture member with the legrest mechanism in an extended position.

With reference to FIGS. 1-11, a seating or furniture assembly 10 (FIGS. 1 and 2) is provided that may include a seat bottom 12, a seatback 14, and a lumbar adjustment mechanism or assembly 16 (FIGS. 3-11). In some configurations, the seatback 14 may be movable relative to the seat bottom 12 between reclined and upright positions. In some configurations, the seating or furniture assembly 10 may include a legrest assembly 18 that is movable relative to the seat bottom 12 between a retracted position (FIG. 1) and an extended position (FIG. 2). The seatback 14 includes a lumbar support section 20 in which the lumbar adjustment assembly 16 is disposed. As will be described in more detail below, the lumbar adjustment assembly 16 can be actuated to move the lumbar support section 20 of the seatback 14 in a lumbar extension direction A to increase occupant lumbar support or in a lumbar retraction direction B to decrease occupant lumbar support. The lumbar adjustment assembly 16 is operable independently of any other mechanism (e.g. a seatback reclining mechanism, tilting mechanism, movable headrest mechanism, or the legrest assembly 18) of the furniture assembly 10.

Figure 3:
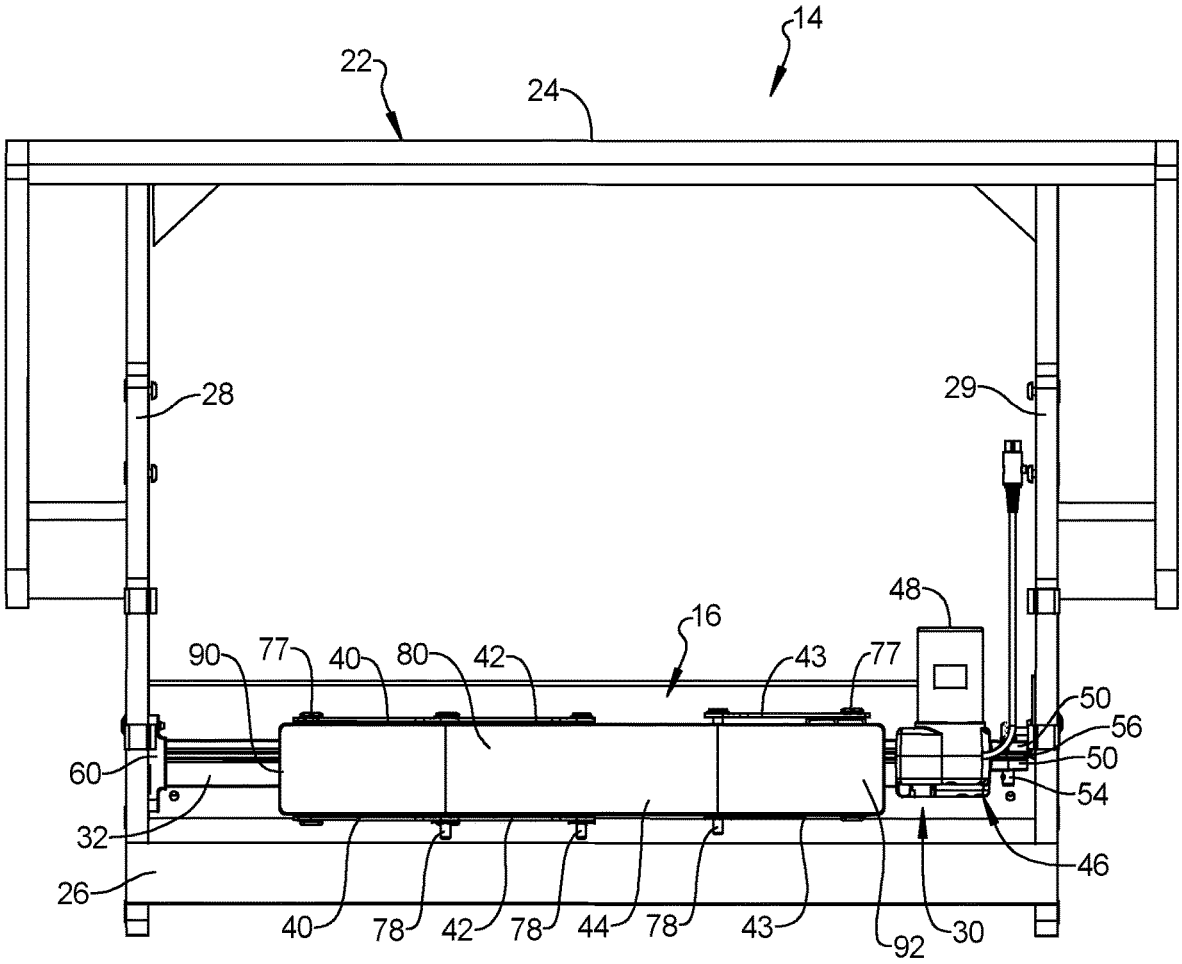
FIG. 3 is a front view of a seatback of the furniture member with upholstery and padding removed to show a lumbar adjustment assembly.
Figure 4:
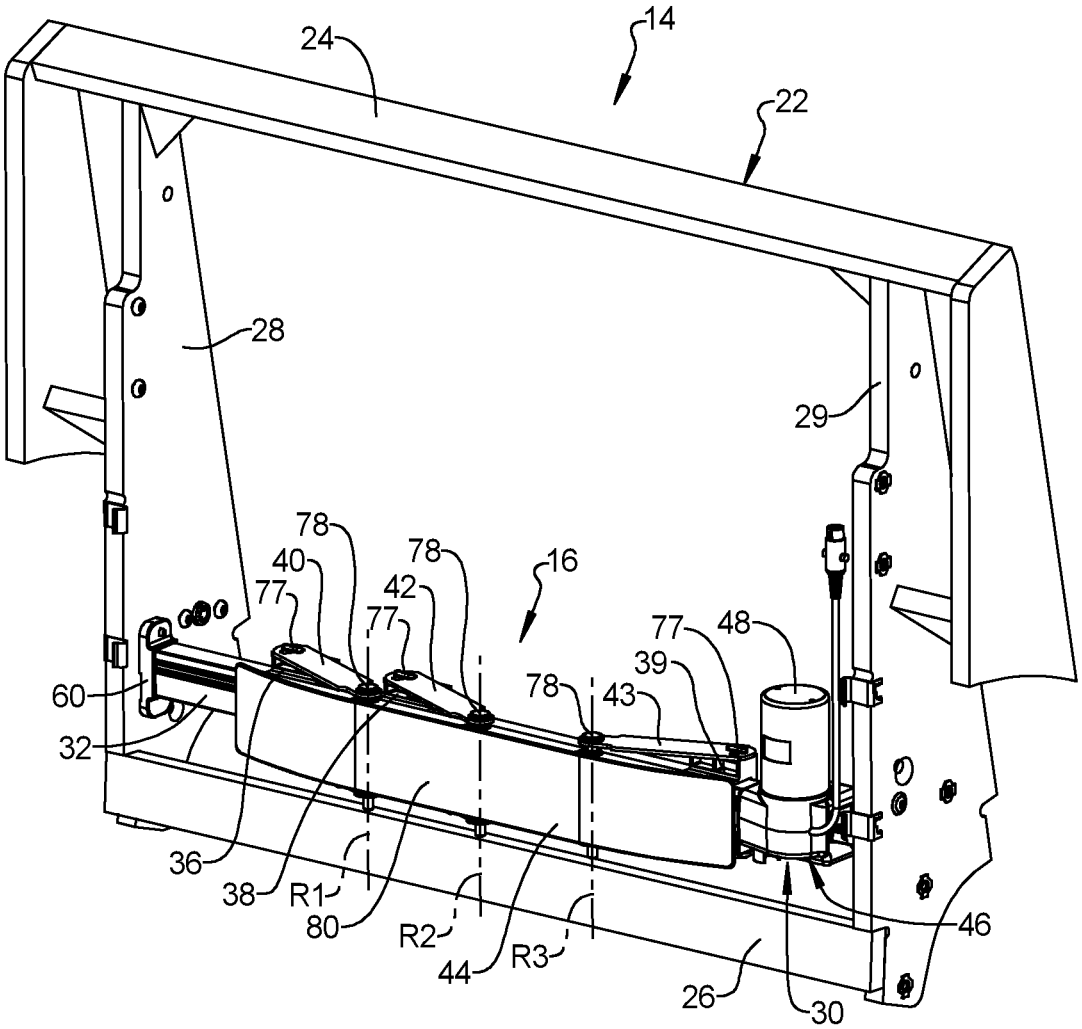
FIG. 4 is a perspective view of the seatback and lumbar adjustment assembly.

Referring now to FIGS. 3 and 4, the seatback 14 includes a seatback frame 22 (which, in FIGS. 1 and 2, is shown covered with padding and upholstery) that may have an upper cross member 24, a lower cross member 26 (i.e., the end adjacent the seat bottom 12 when the seating or furniture assembly 10 is fully assembled), and first and second lateral support members 28, 29 extending between the upper and lower cross members 24, 26. The lumbar adjustment assembly 16 may be mounted to the first and second lateral support members 28, 29. The lumbar adjustment assembly 16 may be disposed between the upper and lower cross members 24, 26 at a location corresponding to the lumbar support section 20 (FIGS. 1 and 2) of the seatback 14.

Figure 5:
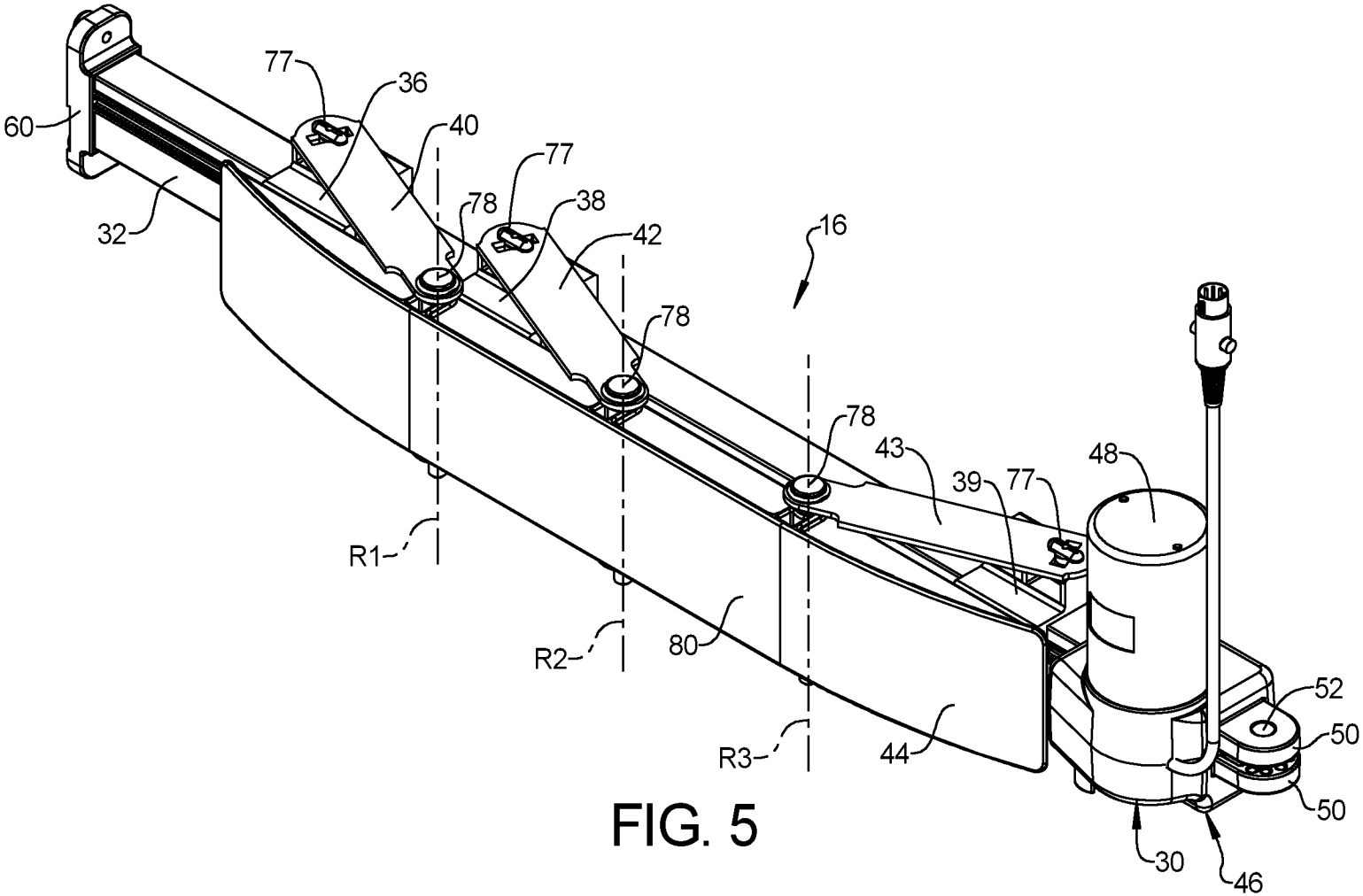
FIG. 5 is a perspective view of the lumbar adjustment assembly in a retracted position.

As shown in FIGS. 3-11, the lumbar adjustment assembly 16 may include a motor assembly 30, a rail 32, a threaded rod 34 (FIGS. 9-11), a first slider block 36, a second slider block 38, a third slider block 39, a pair of first links 40, a pair of second links 42, a pair of third links 43, and a support member (e.g., a lumbar pad) 44. The motor assembly 30 may include a housing 46 and a motor 48. The housing 46 may include one or more mounting projections 50 each having an aperture 52 (FIG. 5). A connecting pin 54 (FIG. 3) may extend through the aperture(s) 52 and engage a mounting bracket 56 that is fixedly attached to the second lateral support member 29. It will be appreciated that the motor assembly 30 could be mounted to the seatback 14 in any suitable manner.

Figure 6:
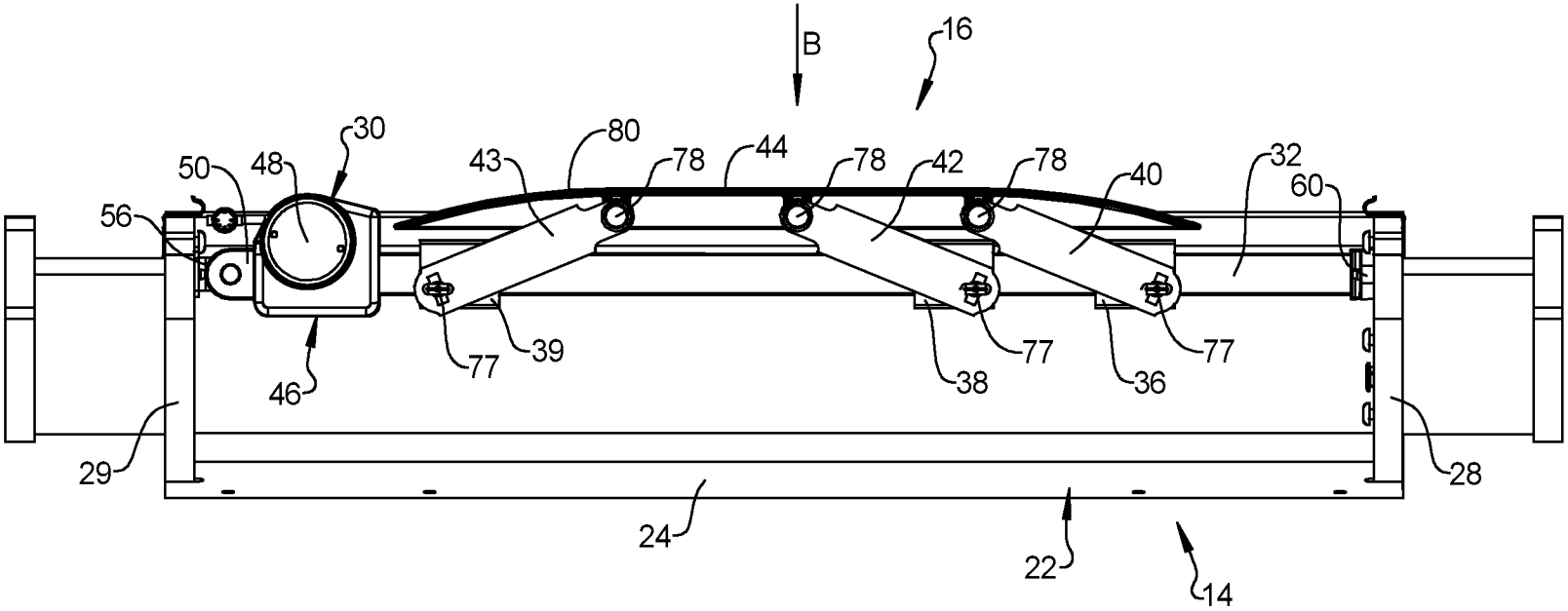
FIG. 6 is a top view of the seatback and lumbar adjustment assembly in the retracted position.

The motor 48 may be attached to and/or disposed at least partially within the housing 46. The motor 48 may be operatively coupled (e.g., via one or more output shafts disposed in the motor housing 46 and, in some configurations, via gears and/or other couplings) to the threaded rod 34 such that operation of the motor 48 causes rotation of the threaded rod 34 about a longitudinal axis of the threaded rod 34. As will be described in more detail below, operation of the motor 48 in a first direction causes the lumbar pad 44 to move relative to the seatback 14 in the lumbar extension direction A toward an extended position (FIGS. 7 and 8), and operation of the motor 48 in a second direction causes the lumbar pad 44 to move relative to the seatback 14 in the lumbar retraction direction B toward a retracted position (FIGS. 5 and 6).

The rail 32 may be an elongated member that defines an internal cavity 58 (FIGS. 10 and 11) in which the threaded rod 34 is disposed. One end of the rail 32 may be fixedly attached to the housing 46 and another end of the rail 32 may include or be attached to a mounting bracket 60. The mounting bracket 60 may be fixedly attached to the first lateral support member 28.

Figure 9:
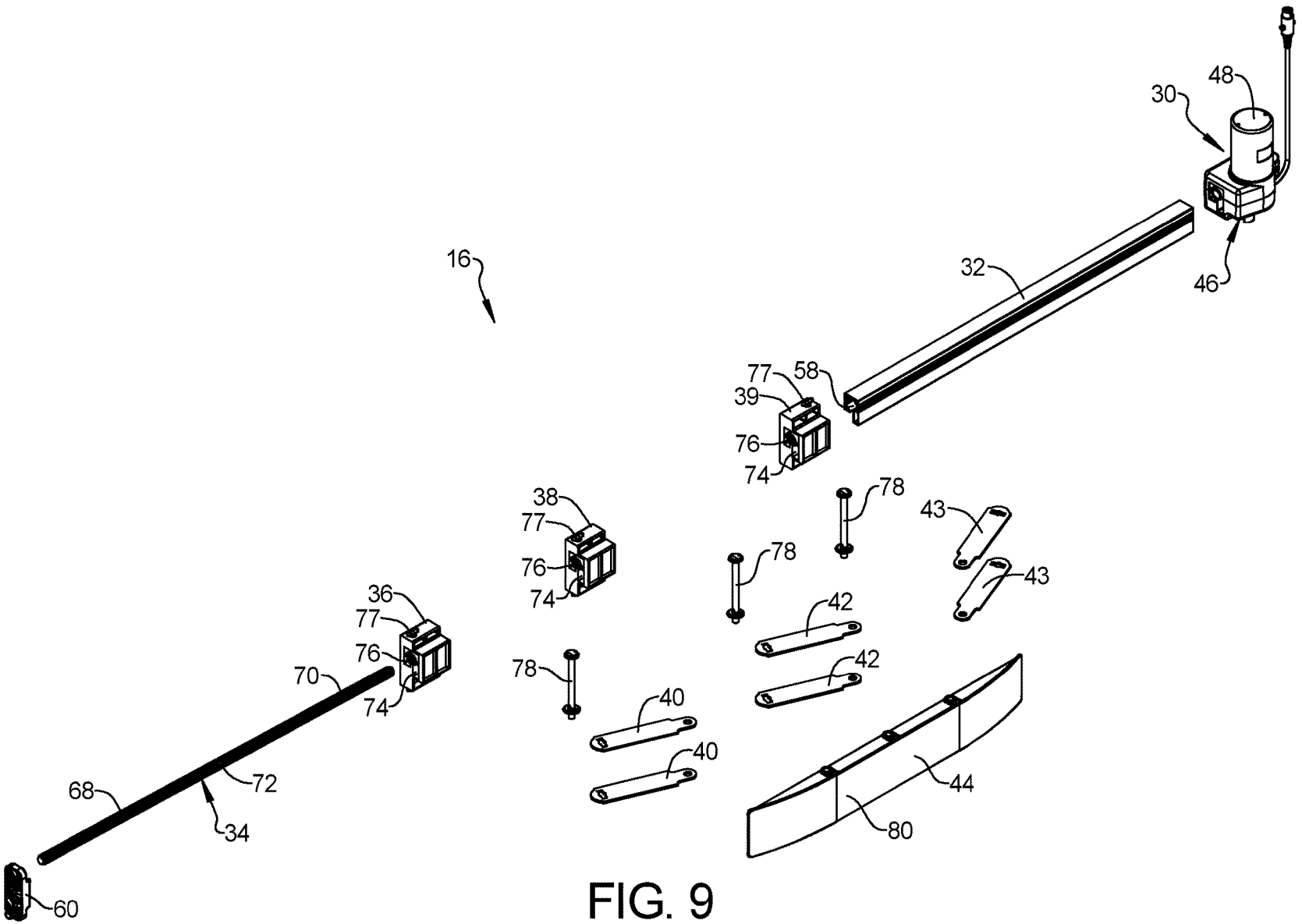
FIG. 9 is an exploded view of the lumbar adjustment assembly.
Figure 11:
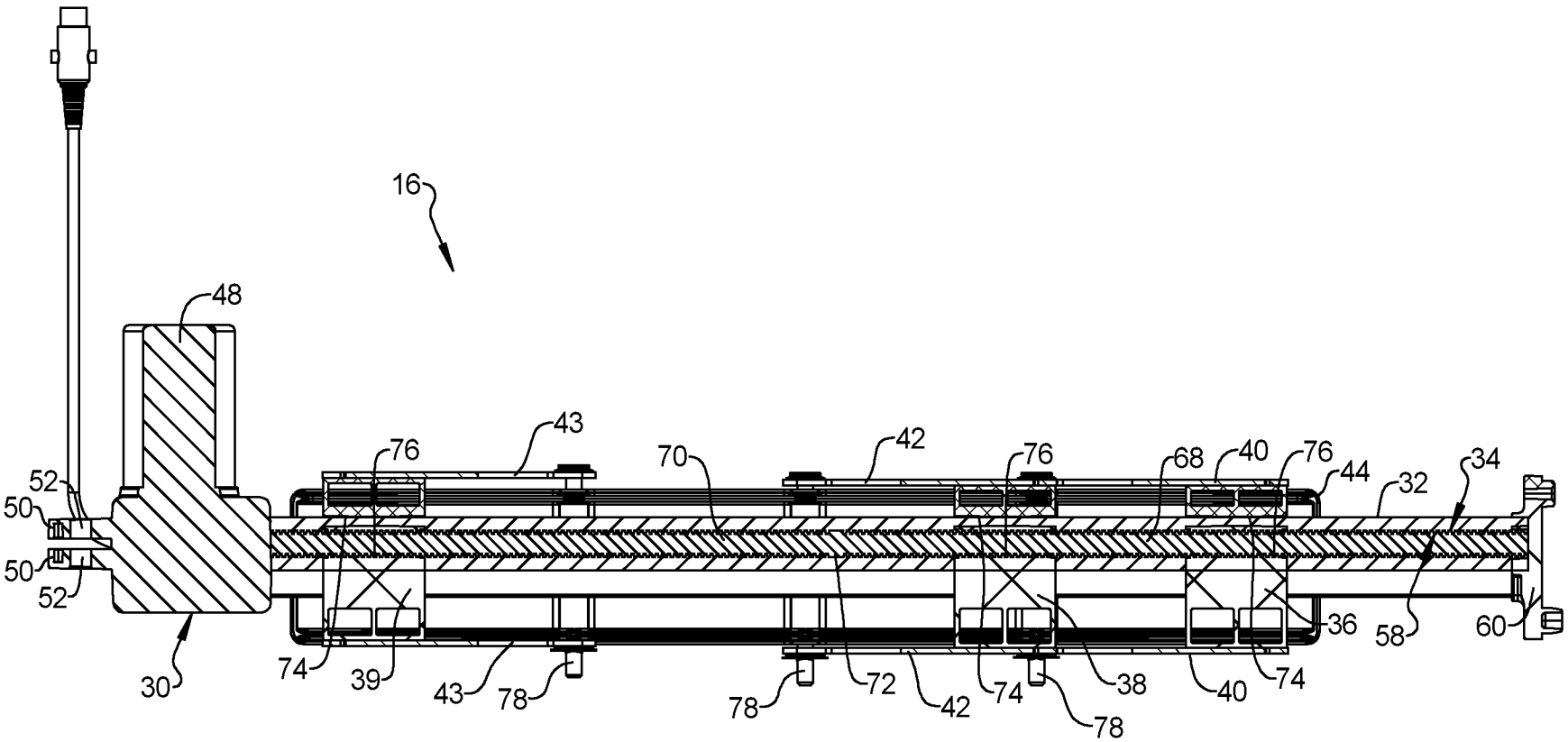
FIG. 11 is another cross-sectional view of the lumbar adjustment assembly.

The threaded rod 34 may be an elongated cylindrical rod that is coupled to the motor 48 and threadably engages the first, second and third slider blocks 36, 38, 39. As shown in FIGS. 9 and 11, the threaded rod 34 may include a first threaded section 68 and a second threaded section 70. The first threaded section 68 and the second threaded section 70 may have threads of opposite handedness. For example, the first threaded section 68 may have right-handed threads and the second threaded section 70 may have left-handed threads, or the first threaded section 68 may have left-handed threads and the second threaded section 70 may have right-handed threads.

The threaded rod 34 may include an intermediate section 72 (FIGS. 9 and 11) disposed between the first and second threaded sections 68, 70. The intermediate section 72 defines a transitional portion of the threaded rod 34 between the first and second threaded sections 68, 70. In some configurations, the intermediate section 72 may be unthreaded. The first threaded section 68 may extend between the motor assembly 30 and the intermediate section 72 and may threadably engage the third slider block 39. The second threaded section 70 may threadably engage the first and second slider blocks 36, 38 and may extend between the intermediate section 72 and the mounting bracket 60 attached to the second lateral support member 28.

Due to the opposite handedness of the first and second threaded portions 68, 70, when the threaded rod 34 rotates, the first and second slider blocks 36, 38 to move in a direction opposite a direction of movement of the third slider block 39. That is, rotation of the threaded rod 34 in one direction causes the first, second and third slider blocks 36, 38, 39 to move along the rail 32 toward the intermediate section 72 (i.e., the first and second slider blocks 36, 38 move toward the third slider block 39 and the third slider block 39 moves toward the first and second slider blocks 36, 38), and rotation of the threaded rod 34 in the opposite direction causes the first, second and third slider blocks 36, 38, 39 to move away from the intermediate section 72 along the rail 32 (i.e., the first and second slider blocks 36, 38 move away from the third slider block 39 and the third slider block 39 moves away from the first and second slider blocks 36, 38).

Figure 10:
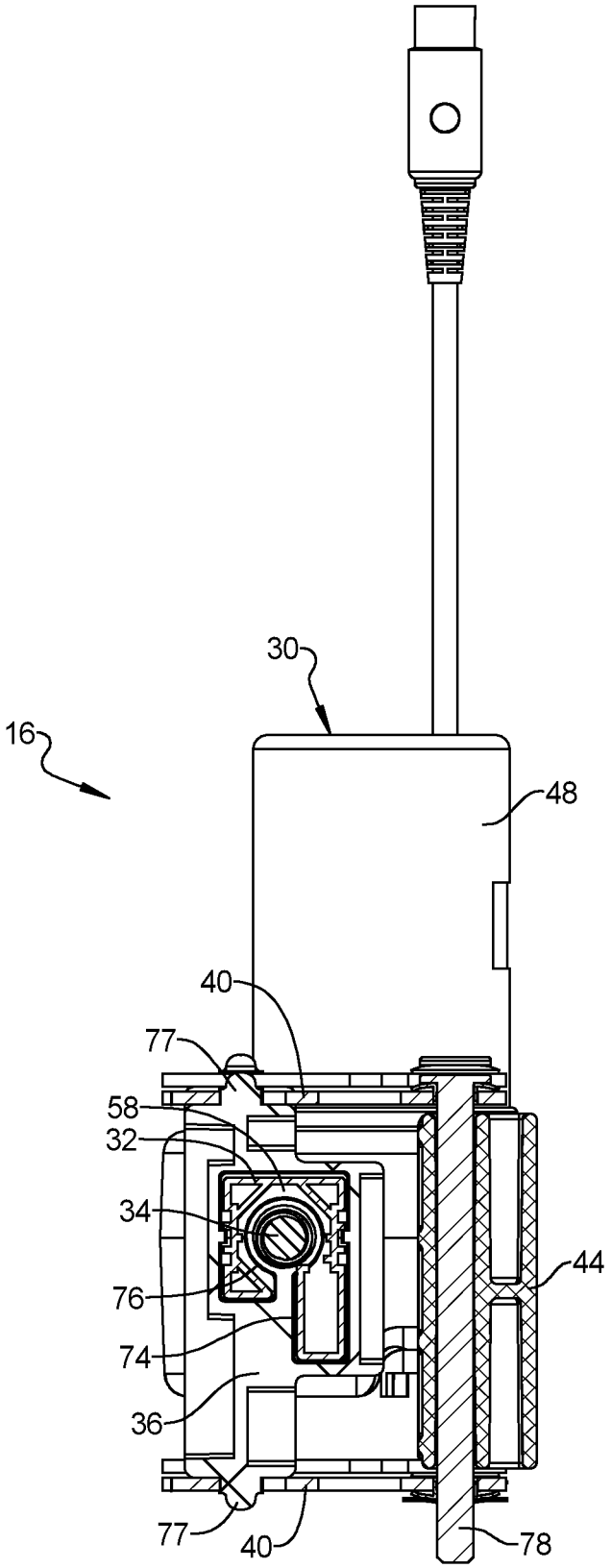
FIG. 10 is a cross-sectional view of the lumbar adjustment assembly.

The first, second and third slider blocks 36, 38, 39 may be similar or identical to each other and may each include a channel 74 that movably receives the rail 32. As shown in FIG. 10, the channel 74 has a cross-sectional shape that substantially matches the outer cross-sectional shape of the rail 32. In this manner, the first, second and third slider blocks 36, 38, 39 can slide along the rail 32.

As shown in FIG. 10, each of the first and second slider blocks 36, 38 may include a nut portion 76 that extends from a main body of the slider block 36, 38 into the channel 74 and threadably engages the threaded rod 34. That is, the nut portion 76 includes a threaded aperture through which the threaded rod 34 is threadably received. The nut portions 76 of the first and second slider blocks 36, 38 threadably engage the first threaded section 68 of the threaded rod 34. The nut portion 76 of the third slider block 39 threadably engages the second threaded section 70 of the threaded rod 34. Therefore, the nut portions 76 of the first and second slider blocks 36, 38 have different threaded handedness than the nut portion 76 of the third slider block 39 (i.e., the nut portions 76 of the first and second slider blocks 36, 38 have the same thread handedness as the first threaded section 68, and the nut portion 76 of the third slider block 39 has the same thread handedness as the second threaded section 70).

Since the cross-sectional shape of the channels 74 of the slider blocks 36, 38, 39 substantially matches the cross-sectional shape of the rail 32, the rail 32 prevents the slider blocks 36, 38, 39 from rotating with the threaded rod 34 and allows the slider blocks 36, 38, 39 to slide along the rail 32 (in a direction along the longitudinal axis of the threaded rod 34) while the threaded rod 34 rotates relative to the rail 32. As described above, because the first and second threaded sections 68, 70 of the threaded rod 34 have threads of opposite handedness, rotation of the threaded rod 34 in one direction causes the first and second slider blocks 36, 38 to move toward the third slider block 39 along the rail 32 (and the third slider block 39 moves toward the first and second slider blocks 36, 38 along the rail 32), and rotation of the threaded rod 34 in the opposite direction causes the first and second slider blocks 36, 38 to move away from the third slider block 39 along the rail 32 (and the third slider block 39 moves away from the first and second slider blocks 36, 38 along the rail 32) (compare FIGS. 5 and 7 or FIGS. 6 and 8).

Figure 7:
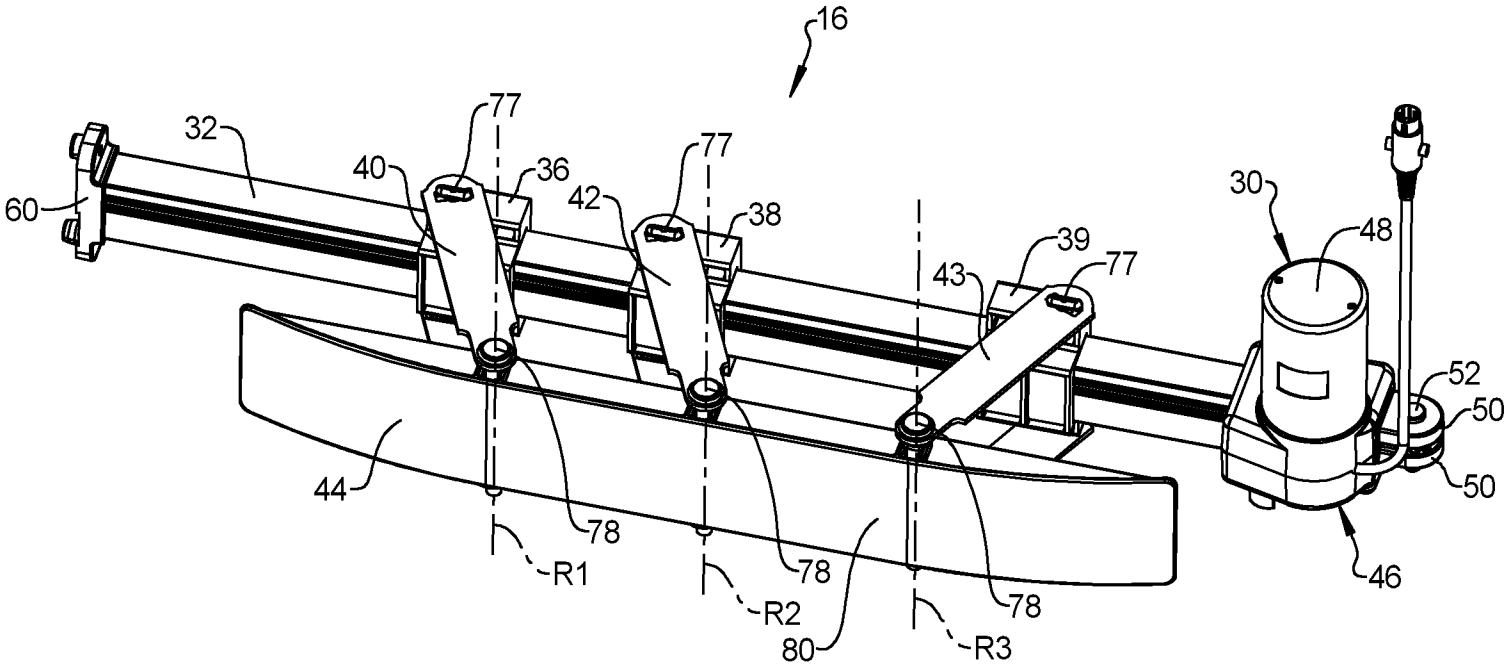
FIG. 7 is a perspective view of the lumbar adjustment assembly in an extended position.
Figure 8:
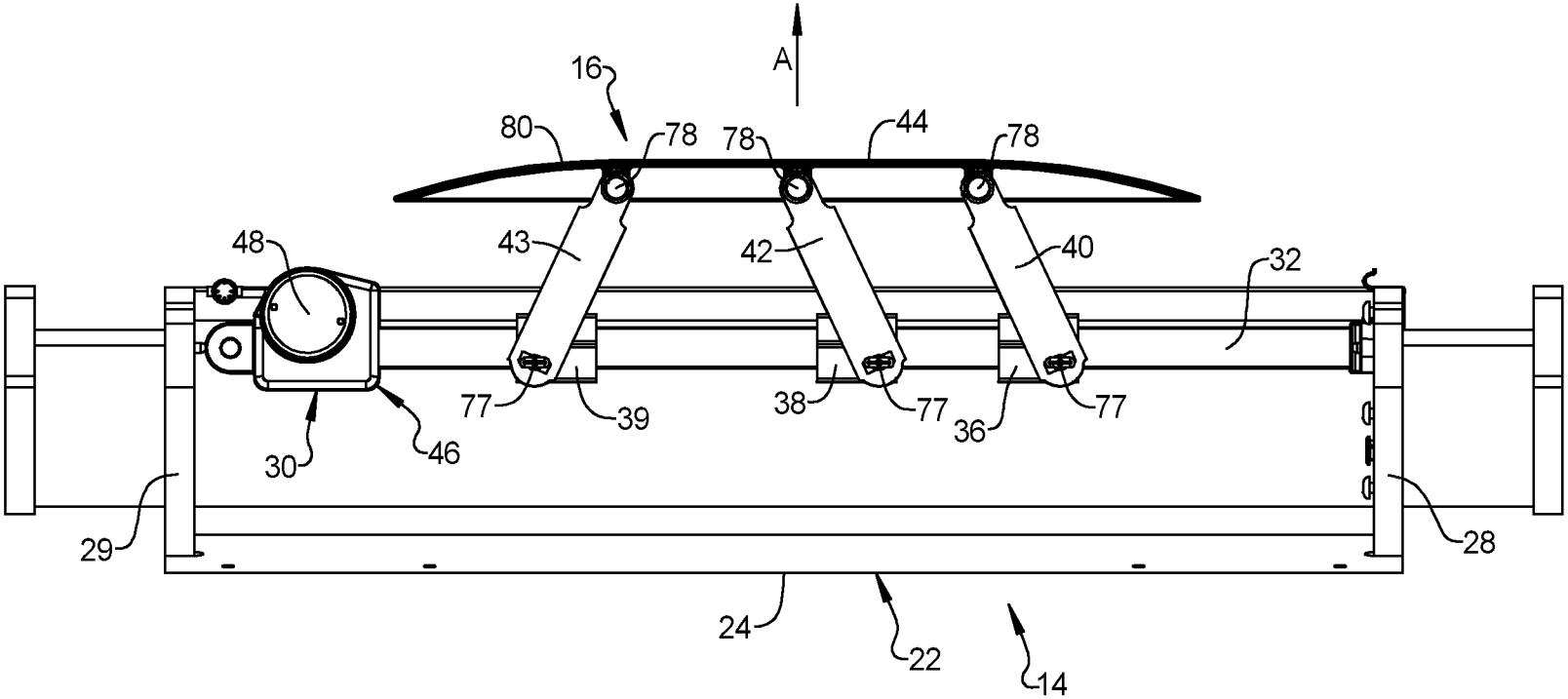
FIG. 8 is a top view of the seatback and lumbar adjustment assembly in the extended position.

The first, second, and third links 40, 42, 43 may be similar or identical to each other. As shown in FIGS. 5 and 7, first ends of the first links 40 are rotatably connected to the first slider block 36 (e.g., via pins or protrusions 77) and second ends of the first links 40 are rotatably connected to the lumbar pad 44 (e.g., via pins or fasteners 78). First ends of the second links 42 are rotatably connected to the second slider block 38 (e.g., via pins or protrusions 77) and second ends of the second links 42 are rotatably connected to the lumbar pad 44 (e.g., via pins or fasteners 78). First ends of the third links 43 are rotatably connected to the third slider block 39 (e.g., via pins or protrusions 77) and second ends of the third links 43 are rotatably connected to the lumbar pad 44 (e.g., via pins or fasteners 78). As shown in FIGS. 5 and 7, the first, second, and third links 40, 42, 43 may be coupled to the lumbar pad 44 at first, second, and third rotational axes R1, R2, R3, respectively. The first, second, and third rotational axes R1, R2, R3 are parallel to each other and spaced apart from each other.

The lumbar pad 44 may be a relatively rigid member and may have a contoured support surface 80 (FIG. 5). The support surface 80 may be in contact with and/or adjacent to the padding and upholstery that covers the seatback 14. The lumbar adjustment assembly 16 may be positioned on the seatback frame 22 such that the support surface 80 corresponds to the lumbar support section 20 of the seatback 14 (i.e., the support surface 80 of the lumbar pad 44 supports the lumbar portion of a person's back who is sitting in the seating or furniture assembly 10).

With continued reference to FIGS. 1-11, operation of the lumbar adjustment assembly 16 will be described in detail. A user sitting in the seating or furniture assembly 10 can actuate the lumbar adjustment assembly 16 to adjust the position of the lumbar support section 20 of the seatback 14. Movement of the lumbar adjustment assembly 16 from the retracted position (FIGS. 5 and 6) to the extended position (FIGS. 7 and 8) causes the lumbar pad 44 to move in the lumbar extension direction A (FIG. 1); and movement of the lumbar adjustment assembly 16 from the extended position to the retracted position causes the lumbar pad 44 to move in the lumbar retraction direction B. Movement of the lumbar pad 44 toward the extended position moves the lumbar support section 20 (e.g., padding and/or upholstery covering the lumbar support section 20 of the seatback 14) in the lumbar extension direction A; and movement of the lumbar pad 44 toward the retracted position allows the lumbar support section 20 (e.g., the padding and/or upholstery covering the lumbar support section 20) to move in the lumbar retraction direction B.

To move the lumbar adjustment assembly 16 from the retracted position to the extended position, the user may press a button (not shown) or other switch or control interface located on the side of the seating or furniture assembly 10 or on a remote control (not shown), for example, to operate the motor 48 to drive the threaded rod 34 in a first rotational direction relative to the rail 32. As described above, rotation of the threaded rod 34 in the first rotational direction causes the first and second slider blocks 36, 38 to move toward the third slider block 39 and the third slider block 39 to move toward the first and second slider blocks 36, 38. As the first and second slider blocks 36, 38 move toward each other along the rail 32, the links 40, 42, 43 rotate relative to the slider blocks 36, 38, 39 and force the lumbar pad 44 to move linearly in the lumbar extension direction A (e.g., from the retracted position to the extended position) (see FIG. 8). The lumbar extension direction A may be perpendicular to the direction in which the slider blocks 36, 38, 39 move along the rail 32. In other configurations, the links 40, 42, 43 could be configured such that the lumbar extension direction A extends at a non-perpendicular angle relative to the rail 32.

To move the lumbar adjustment assembly 16 from the extended position to the retracted position, the user may press another button (not shown) on the side of the seating or furniture assembly 10 or on the remote control (not shown), for example, to operate the motor 48 to drive the threaded rod 34 in a second rotational direction (opposite the first rotational direction) relative to the rail 32. Rotation of the threaded rod 34 in the second rotational direction causes the first and second slider blocks 36, 38 to move away from the third slider block 39 and the third slider block 39 to move away from the first and second slider blocks 36, 38. As the first and second slider blocks 36, 38 move in a direction opposite the third slider block 39 along the rail 32, the links 40, 42, 43 rotate relative to the slider blocks 36, 38, 39 and force the lumbar pad 44 to move linearly in the lumbar retraction direction B (see FIG. 6). The lumbar retraction direction B may be perpendicular to the direction in which the slider blocks 36, 38, 39 move along the rail 32. In other configurations, the links 40, 42, 43 could be configured such that the lumbar retraction direction B extends at a non-perpendicular angle relative to the rail 32.

As described above, the slider blocks 36, 38, 39 are connected to the lumbar pad 44 via links 40, 42, 43 at three spaced-apart locations (i.e., at the first, second, and third rotational axes R1, R2, R3) along a length of the lumbar pad 44. This configuration provides adequate support for the lumbar pad 44 along the entire length of the lumbar pad 44 so that a load applied to the any point on the surface 80 of the lumbar pad 44 can be adequately supported so that undesired movement or deflection of the lumbar pad 44 is reduced or eliminated. This may be particularly beneficial for a lumbar adjustment assembly 16 mounted in a wide seat assembly 14. For example, the furniture assembly 10 shown in FIGS. 1 and 2 is an oversized or extra-wide chair (also known as a "chair-and-a-half"). The three slider blocks 36, 38, 39 and three pairs of links 40, 42, 43 supporting the extra-wide lumbar pad 44 in an extra-wide chair (or in an extra-wide backrest assembly 14 in a sofa, for example) adequately supports the lumbar pad 44 and reduces or prevents undesired movement of deflection of the lumbar pad 44 when subjected to a load at or near opposing ends 90, 92 (FIG. 3) of the lumbar pad 44.

In the particular example shown in FIGS. 1 and 2, the assembly 10 is a chair (e.g., an oversized chair); however, the principles of the present disclosure are not limited to chairs. That is, the lumbar adjustment assembly 16 can be incorporated into a variety of types of seating or furniture assemblies including single or multiple person furniture members, sofas, sectional members, loveseats, vehicle seating, dental seating, medical seating, etc. Furthermore, in any given seating or furniture assembly, the lumbar adjustment assembly 16 may be one of a plurality of movable or adjustable portions of the seating or furniture assembly, or the lumbar adjustment assembly 16 could be the only movable or adjustable portion of the seating or furniture assembly.

While the lumbar adjustment assembly 16 is described above as being driven by the motor assembly 30, in some configurations, the lumbar adjustment assembly 16 could be manually driven.

Furthermore, while the threaded rod 34 shown in the figures is a single, unitary body, in some configurations, the threaded rod 34 could be formed by welding or otherwise attaching two rods (one rod corresponding to each of the first and second threaded sections 68, 70) together.

In some configurations, the threads of the first and second threaded sections 68, 70 have the same pitch. In other configurations, the threads of the first threaded section 68 may have a different pitch than the threads of the second threaded section 70. The different pitches of the threads of the first and second threaded sections 68, 70 can allow the first and second slider blocks 36, 38 to move at a different speed than the third slider block 39.

The links 40, 42, 43 could be shaped, sized, oriented and connected to the slider blocks 36, 38, 39 and lumbar pad 44 in any desired manner to produce any desired movement of the lumbar pad 44 (or multiple lumbar pads). Furthermore, the threaded rod 34, slider blocks 36, 38, 39 and links 40, 42, 43 could be configured to move additional or alternative components of a seating or furniture assembly (i.e., instead of or in addition to the lumbar pad 44).

While the first and second slider blocks 36, 38 are described above as being engaged with the first threaded section 68 of the threaded rod 34 and the third slider block 39 is described above a being engaged with the second threaded section 70, in some configurations of the assembly 16, two of the slider blocks 36, 38, 39 may be disposed on the second threaded section 70 and one of the blocks 36, 38, 39 could be on the first threaded section 68. Furthermore, in some configurations of the assembly 16, there could be more than three slider blocks or fewer than three slider blocks. For example, the assembly 16 could include only two slider blocks (e.g., one on each of the threaded sections 68, 70). As another example, the assembly 16 could include four (or more) slider blocks (one or more slider blocks on the first threaded section 68 and one or more slider blocks on the second threaded section 70). Regardless of the number of slider blocks in the assembly 16, each slider block may be coupled to the lumbar pad 44 by one or more links (e.g., like links 40, 42, 43). Furthermore, while the section of the threaded rod 34 that is adjacent to motor assembly 30 is referred to above and in the figures as "the second threaded section 70," the section of the threaded rod 34 that is adjacent to motor assembly 30 could be termed "the first threaded section 68."

Furthermore, while the assembly 16 is described above as being a lumbar adjustment assembly 16, in some configurations, the assembly 16 could be a movable headrest assembly (e.g., where the support member 44 is a headrest support member), a movable footrest assembly, movable legrest assembly, or a movable armrest assembly, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a seat bottom;

a seatback disposed adjacent the seat bottom and including a seatback frame; and a lumbar adjustment assembly mounted to the seatback frame and including a rail, a threaded rod disposed within the rail, a first slider block slidably engaging the rail, a second slider block slidably engaging the rail, a third slider block slidably engaging the rail, a lumbar pad, and a plurality of links connecting the lumbar pad to the first, second, and third slider blocks, wherein the threaded rod includes a first threaded section having threads with a first handedness and a second threaded section having threads with a second handedness that is opposite the first handedness, and wherein the first and second slider blocks threadably engage the first threaded section and the second slider block threadably engages the second threaded section.

2. The assembly of claim 1, further comprising a motor assembly attached to the rail and rotatably driving the threaded rod relative to the rail.

3. The assembly of claim 1, wherein the links include a pair of first links, a pair of second links, and a pair of third links.

4. The assembly of claim 3, wherein a first end of each of the first links is rotatably coupled to the first slider block, wherein a second end of each of the first links is rotatably coupled to the lumbar pad, wherein a first end of each of the second links is rotatably coupled to the second slider block, wherein a second end of each of the second links is rotatably coupled to the lumbar pad, wherein a first end of each of the third links is rotatably coupled to the third slider block, wherein a second end of each of the third links is rotatably coupled to the lumbar pad.

5. The assembly of claim 4, wherein the second ends of the first links, the second ends of the second links, and the second ends of the third links are rotatably coupled to the lumbar pad at first, second, and third rotational axes, respectively, and wherein the first, second, and third rotational axes are spaced apart from each other and parallel to each other.

6. The assembly of claim 1, wherein the lumbar pad moves in a direction perpendicular to directions in which the first, second, and third slider blocks move along the rail.

7. The assembly of claim 6, wherein the lumbar pad moves away from the rail when the first and second slider blocks move toward the third slider block along the rail, and wherein the lumbar pad moves toward from the rail when the first and second slider blocks move away from the third slider block along the rail.

8. The assembly of claim 1, wherein the seatback frame includes a lower cross member, an upper cross member, a first lateral support member, and a second lateral support member, and wherein a motor assembly of the lumbar adjustment assembly is attached to the first lateral support member and the rail is attached to the second lateral support member.

9. The assembly of claim 1, wherein each of the first, second, and third slider blocks includes a channel that slidably and non-rotatably receives the rail.

10. The assembly of claim 1, wherein the threaded rod is a single, unitary body.

11. An assembly comprising:

a frame;

a motor assembly including a housing attached to the frame;

a rail including a first end attached to the motor assembly and a second end attached to the frame;

a threaded rod coupled to the motor assembly and disposed within a channel of the rail, the threaded rod including a first threaded section having threads with a first handedness and a second threaded section having threads with a second handedness that is opposite the first handedness;

a first slider block slidably engaging the rail and threadably engaging the first threaded section;

a second slider block slidably engaging the rail and threadably engaging the first threaded section;

a third slider block slidably engaging the rail and threadably engaging the second threaded section; and a plurality of links rotatably coupled to the first, second, and third slider blocks.

12. The assembly of claim 11, further comprising a support member attached to the plurality of links.

13. The assembly of claim 12, wherein the links include a pair of first links, a pair of second links, and a pair of third links, wherein a first end of each of the first links is rotatably coupled to the first slider block, wherein a second end of each of the first links is rotatably coupled to the support member, wherein a first end of each of the second links is rotatably coupled to the second slider block, wherein a second end of each of the second links is rotatably coupled to the support member, wherein a first end of each of the third links is rotatably coupled to the third slider block, wherein a second end of each of the third links is rotatably coupled to the support member.

14. The assembly of claim 13, wherein the second ends of the first, second, and third links are rotatably coupled to the support member at first, second, and third rotational axes, respectively, and wherein the first, second, and third rotational axes are spaced apart from each other and parallel to each other.

15. The assembly of claim 12, wherein the support member is a lumbar pad, and wherein the frame is a seatback frame.

16. The assembly of claim 15, wherein the seatback frame includes a lower cross member, an upper cross member, a first lateral support member, and a second lateral support member, and wherein the housing of the motor assembly is attached to the first lateral support member and the second end of the rail is attached to the second lateral support member.

17. The assembly of claim 12, wherein the support member moves in a direction perpendicular to directions in which the first, second, and third slider blocks move along the rail.

18. The assembly of claim 17, wherein the support member moves away from the rail when the first and second slider blocks move toward the third slider block along the rail, and wherein the support member moves toward from the rail when the first and second slider blocks move away from the third slider block along the rail.

19. The assembly of claim 11, wherein each of the first, second, and third slider blocks includes a channel that slidably and non-rotatably receives the rail.

20. The assembly of claim 11, wherein the threaded rod is a single, unitary body.

* * * * *